US007073858B2

(12) United States Patent
Fisher et al.

(10) Patent No.: US 7,073,858 B2
(45) Date of Patent: Jul. 11, 2006

(54) SEATING SYSTEM

(75) Inventors: David John Fisher, Wantirna South (AU); Adam William Fisher, Wantirna South (AU)

(73) Assignee: Camatic PTY, Limited, Victoria (AU)

( * ) Notice: Subject to any disclaimer, the term of this patent is extended or adjusted under 35 U.S.C. 154(b) by 0 days.

(21) Appl. No.: 11/007,069

(22) Filed: Dec. 8, 2004

(65) Prior Publication Data

US 2005/0146180 A1 Jul. 7, 2005

Related U.S. Application Data

(63) Continuation of application No. 09/914,231, filed as application No. PCT/AU00/01150 on Sep. 21, 2000, now abandoned.

(30) Foreign Application Priority Data

Sep. 21, 1999 (AU) ..... PQ2970

(51) Int. Cl.
*A47C 1/12* (2006.01)

(52) U.S. Cl. ..... 297/232; 297/440.22; 52/9

(58) Field of Classification Search ..... 104/118, 104/121, 111, 53; 297/440.22, 440.2, 440.21, 297/335, 165, 452.65, 452.18, 232, 452.2, 297/148, 145, 251, 411.44, 411.29, 411.25, 297/331; 348/429, 430; 52/735.1, 730.4, 52/733.4, 734.2, 726.2, 8, 9

See application file for complete search history.

(56) References Cited

U.S. PATENT DOCUMENTS

| | | | | |
|---|---|---|---|---|
| 146,432 | A | 1/1874 | Close | |
| 1,374,467 | A | 4/1921 | Park | |
| 3,114,575 | A | 12/1963 | Eames et al. | |
| 3,194,601 | A | 7/1965 | Hoven et al. | |
| 3,233,939 | A | 2/1966 | Chapman | |
| 3,343,870 | A | 9/1967 | Thatcher et al. | |
| 3,762,765 | A | 10/1973 | Piretti | |
| 3,885,766 | A | 5/1975 | Resch et al. | |
| 3,889,999 | A | 6/1975 | Mackintosh | |
| 4,133,579 | A | 1/1979 | Springfield | |
| 4,277,101 | A | 7/1981 | Vogel | |
| 4,453,363 | A | 6/1984 | Koller | |
| 4,493,172 | A | 1/1985 | Jones | |
| 4,694,531 | A * | 9/1987 | Foy | 104/111 |

(Continued)

FOREIGN PATENT DOCUMENTS

| | | |
|---|---|---|
| GB | 2274391 | 7/1994 |

(Continued)

*Primary Examiner*—Peter R. Brown
(74) *Attorney, Agent, or Firm*—Gardner Carton & Douglas LLP

(57) ABSTRACT

A seating system is provided including a beam for supporting seats, wherein the seats are individually mounted to the beam at any selected longitudinal position along the beam. The system facilitates seat positioning and repositioning in a manner that optimizes seating adaptability and ease of installation. The beam preferably includes integral first and second track portions. The first track portion includes a channel that receives bracket-mounted connectors by which the beam is fixed relative to the ground. Each of the seats has at least one seat support with a clamp portion that secures to the second track portion of the beam, free from the channel to avoid interfering with the connectors, regardless of the point at which the support is clamped to the beam. The second track portion is preferably shaped to include a rear overhang and front overhang defining oppositely directed undercut surfaces on which the seat support is securely mounted.

36 Claims, 8 Drawing Sheets

U.S. PATENT DOCUMENTS

| | | | | |
|---|---|---|---|---|
| 4,850,159 | A | | 7/1989 | Conner |
| 5,098,156 | A | * | 3/1992 | Vogel ..... 297/232 |
| 5,246,270 | A | * | 9/1993 | Vogel ..... 297/232 |
| 5,342,110 | A | | 8/1994 | Merrick |
| 5,375,914 | A | | 12/1994 | Donnelly |
| 5,470,128 | A | | 11/1995 | Kerkham |
| 5,598,785 | A | * | 2/1997 | Zaguroli, Jr. ..... 104/111 |
| 5,636,900 | A | | 6/1997 | Wilkie et al. |
| 5,661,945 | A | | 9/1997 | Henriksson et al. |
| 5,671,975 | A | | 9/1997 | Muller |
| 5,984,417 | A | | 11/1999 | Wang |
| 6,092,864 | A | | 7/2000 | Wycech et al. |
| 6,095,603 | A | | 8/2000 | Hock |
| 6,190,047 | B1 | * | 2/2001 | Haag et al. ..... 104/118 |
| 6,293,621 | B1 | | 9/2001 | Marsh et al. |
| 6,296,315 | B1 | | 10/2001 | Jensen |

FOREIGN PATENT DOCUMENTS

| | | | | |
|---|---|---|---|---|
| JP | 01175564 | A | * | 7/1989 |

* cited by examiner

SEATING SYSTEM

CROSS-REFERENCE TO RELATED APPLICATION

This patent application is a continuation of copending U.S. patent application Ser. No. 09/914,231, filed Sep. 14, 2001 now abandoned, which claims the benefit of International Application No. PCT/AU00/01150, filed Sep. 21, 2000, which claims priority to Australian Patent Application No. PQ 2970 99, filed Sep. 21, 1999, each of which is hereby incorporated herein by reference in its entirety.

FIELD OF THE INVENTION

This invention relates to a seating system and in particular, for a system which is adapted for use in stadiums and in auditoriums. In our description we will refer, generally, to stadium seating but this is not to limit the concept of the invention in any way.

BACKGROUND OF THE INVENTION

Stadium seating is usually based about beams or the like which are connected either directly or indirectly to a floor or vertical riser in the stadium, individual seats are then connected to the beam by way of a clamp or the like which clamp has one component on the seat and one component which can be placed thereover on the other side of the beam and the two can be interconnected. Generally this means that the system is designed for a particular seating arrangement and although individual seats can be removed and replaced, the actual arrangement of seats is basically fixed.

In an alternative arrangement the beam has been provided with plates or the like which are welded or otherwise permanently attached thereto to which individual seats are connected.

In a still further arrangement, individual seats can be connected to the floor or riser.

These arrangements are very inflexible and are usually designed for the particular stadium in a particular configuration and can not be varied from this.

SUMMARY OF THE INVENTION

One object of the invention is to provide a seating system whereby the location of the seats is very much more flexible than has previously been the case.

The invention, in one aspect, comprises a seating system having a beam which is adapted to be connected to a surface adjacent the position at which seats are to be located, means whereby at least one seat can be connected to the beam characterized in that the beam is so formed as to be adapted to receive a formation on the base of a seat whereby the seat can be located at any required position along the beam.

The beam may comprise an extrusion having two spaced parts one of which is adapted to receive means whereby the extrusion can be connected directly or indirectly to a support and the other part provides means whereby seats can be connected to the extrusion, the two portions of the beam being arranged that connection of seats to the extrusion is in no way obstructed by the connection of the beam to supports.

Then a third aspect of the invention we provide a seat for a seating system which has a back member which is adapted to carry the load of the seat and a seat support which has two arms which are adapted for connection to the back member at two spaced positions so that effectively a truss is formed, one of the arms of the support being adapted to be connected to a beam to locate the seat and the support also having means whereby a seat assembly can be connected thereto.

The seat support may include a pivot so the seat can be pivotally connected thereto.

The invention also provides a seat having means whereby identification can readily be provided it may also be provided with means whereby a writing tablet or an audio/visual display can be associated therewith.

Seats can also be provided with means whereby they can be readily upholstered and re-upholstered can be supplied with arms, extended backs and have other modifications associated therewith without any necessity for re-engineering.

In an embodiment, a seating system is provided a plurality of brackets mounted to a fixed surface, and a plurality of connectors, each of the connectors being mountable to a respective one of the brackets. Additionally, the seating system includes an elongate beam adapted to be mounted to the connectors in a generally horizontal orientation. The beam includes a lower portion defining a channel, the channel being shaped to slidably receive the connectors from an end of the beam. The beam includes an elongate upper portion having a rear overhang with a rear undercut surface that projects in a first direction and a front overhang with an undercut surface that extends in a generally opposite direction from the rear overhang. Also, the seating system includes at least one seat support. Each of the supports includes a clamp portion adapted to be removably mounted to the upper portion free of the lower portion so that the seat base can be mounted at any position along a length of the beam, free from interference with the connectors and brackets. The clamp portion being removable in order to facilitate selective repositioning after installation. The clamp portion includes a return portion that is cooperatively shaped to fit against the upper portion and over the rear overhang in contact with the undercut surface. The support further has movable fastener mounted to the return such that the fastener grips over the front overhang in contact with the front undercut surface.

In order that the invention may be more readily understood we shall describe, in relation to the accompanying drawings, one particular embodiment of the invention together with certain modifications that can be made to it.

DETAILED DESCRIPTION OF THE DRAWING FIGURES AND THE PREFERRED EMBODIMENTS

Seats of the invention are adapted to be connected to a beam 10 which in the preferred, illustrated, form is an aluminum extrusion which is adapted to be connected to fittings located on a riser behind the required position for the seats or on the floor where the seats are to be located.

Figure 6:
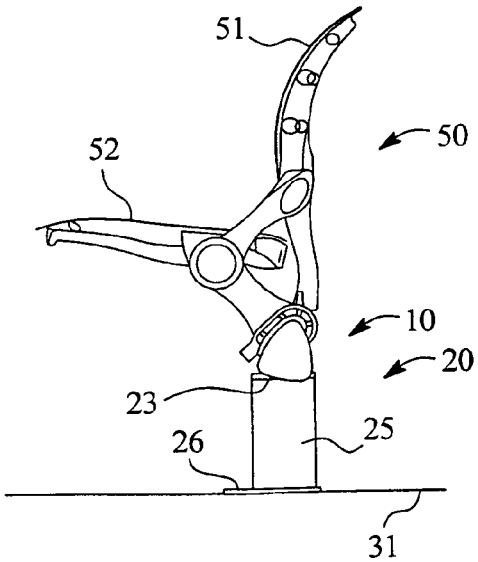
FIG. 6 is a side view of the seat assembly with the seat lowered.
Figure 7:
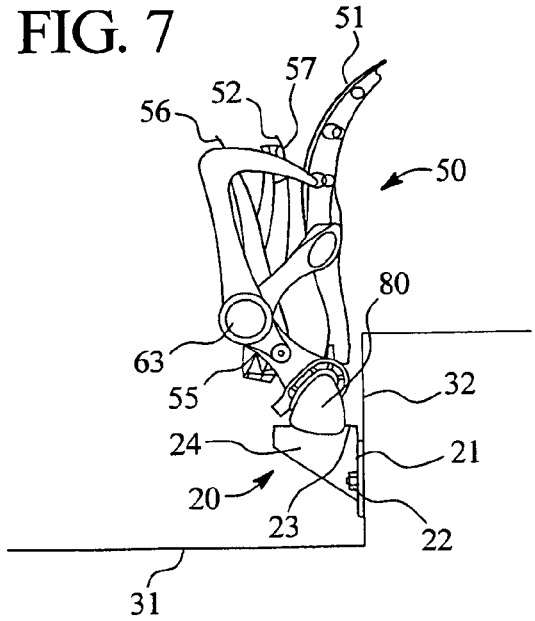
FIG. 7 is a view similar to FIG. 6 with the seat raised.

When one considers stadium seats it will be appreciated that these are normally located on a flat portion 31 of the stadium floor with a riser 32 directly behind so that the seats are stepped to enable good vision from all seats. In some arrangements, there may be two or more rows of seats between each riser.

Where there is such a riser it is often convenient to attach the beam to this as shown in FIG. 7. Alternatively, if it is attached to a flat portion of the floor, the arrangement can be as shown in FIG. 6.

There are provided mounting brackets 20, which may are preferably made of steel but could be of a glass reinforced plastics material or the like.

Figure 5:
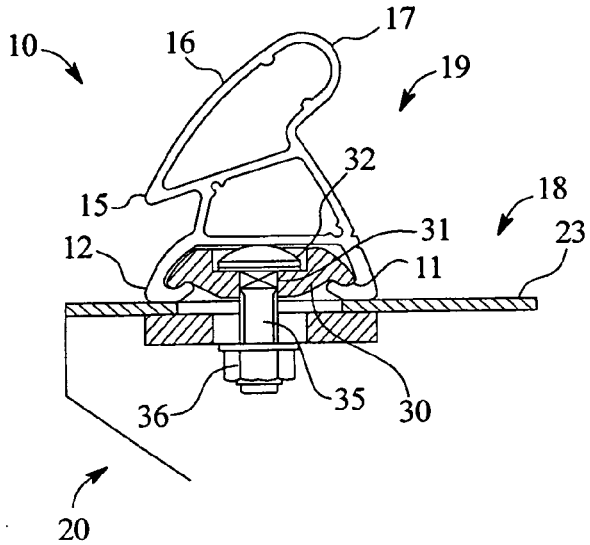
FIG. 5 is an end view of the extrusion, showing a connector therein and being connected to a bracket.

As illustrated in FIGS. 5 and 7, the bracket 20 is designed to be connected to a riser 32 and has a plate 21 which abuts the riser and is connected thereto by bolts 22. A plate 23 which receives the beam 10 may be supported by a fillet 24. The connection of the beam to the plates 23 will be described in greater detail below.

Figure 3:
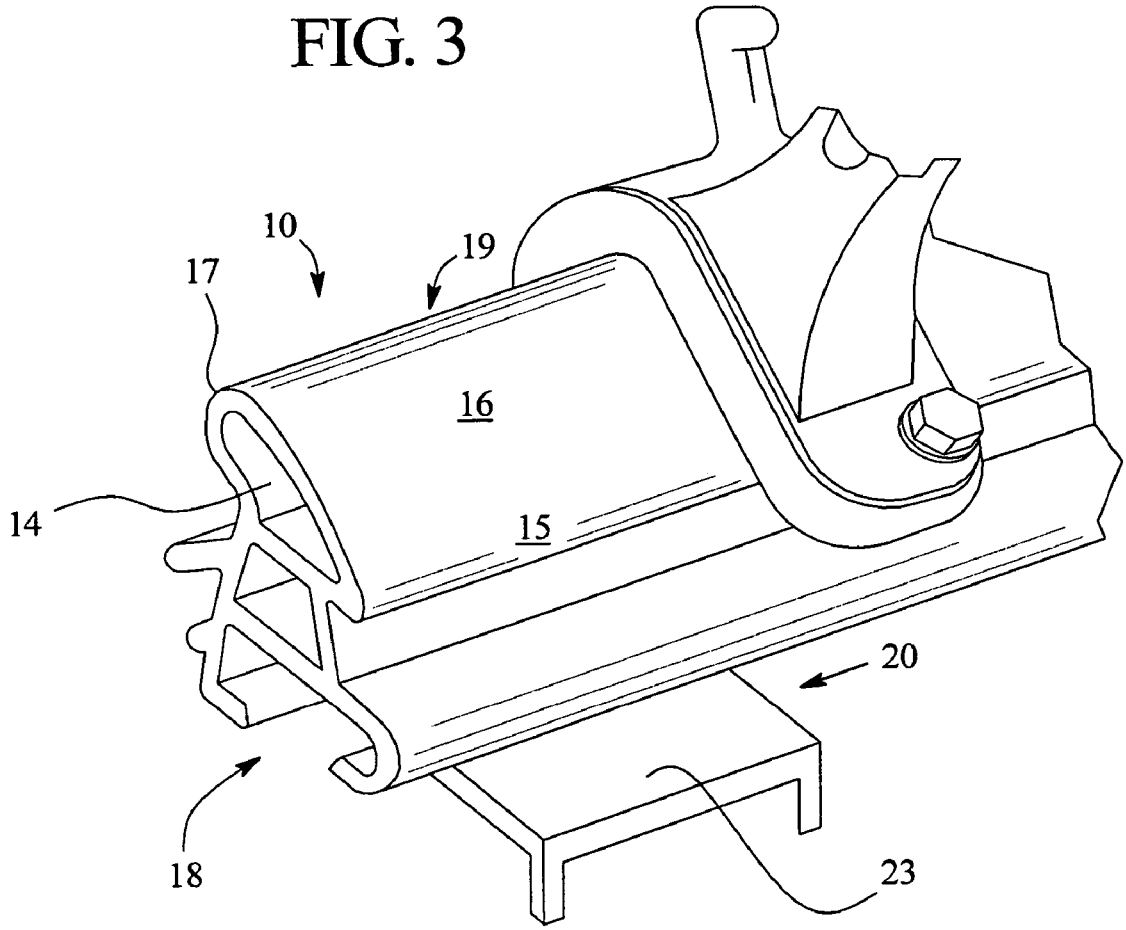
FIG. 3 is a perspective of the beam and its attachment to a riser and the attachment of one side of a seat thereto.
Figure 4:
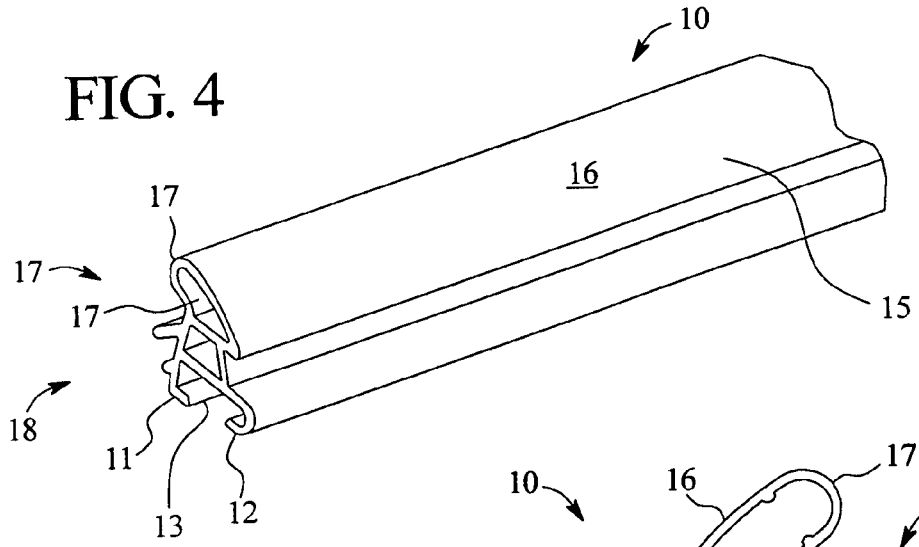
FIG. 4 is a perspective of the beam extrusion.

As illustrated in FIGS. 3, 4, and 5, the beam includes lower portion or first track portion 18 and an upper portion or second track portion 19. The first track portion 18 is configured to be mounted to the brackets 20 with connectors 30 (FIG. 5). The second track portion 19 is configured so that seat supports 60 can be mounted thereon.

One aspect of the invention is that the portion 19 of the beam 10 to which the seats 50 are connected is distinct from the portion 18 which is connected to the mounting brackets 20, the mounting of the beam does not in any way adversely effect the positioning of the seats on the beam. In other words, the seat supports, mounted to the second track portion of the beam, remain free from the first track portion so as to avoid interfering with any of the fixed connections at the brackets, and likewise the connection of the bracket to the first track portion of the beam is free from the second track portion to avoid interfering with any of the seat supports. Thus, the mounting brackets 20 can be fitted at positions which are desirable to the fitter and are not constrained to be fitted to specific positions, to enable the seats to be connected where required, which has been the case in the past.

That is, should there be any flaw in the concrete or other surface where a mounting bracket is to be connected, or should there be a ventilating duct or cable duct or the like, the mounting brackets can simply be located in a position adjacent this obstruction.

As can be seen in FIG. 4, the beam 10, has, at its lower end in the second track portion 18, a pair of inwardly turned ribs 11, 12 which define opposite sides of a slot shaped opening to the cavity or channel 13 which is adapted to receive the connector 30. The first track portion 18 defines a channel 13, viewable in FIG. 4. As is illustrated in FIG. 5, the channel 13 is shaped to cooperatively receive a series of respective connectors 30 fixed to the brackets 20. Turning to FIG. 5, it is illustrated that the ribs 11, 12 contact against the connectors 30 within the channel. It will be appreciated that the connectors 30 can be inserted into the channel 13 from an opening at the end of the beam 10, and the ribs 11, 12 contact the connectors at an interior of the channel. As illustrated, the connectors 30 fit closely within a cross-sectional profile of the channel.

The connector 30 may be of aluminium, has an external shape to be received in and moved along the channel. As shown in FIG. 5, a central aperture 31 is disposed through the connector 30 to receive a bolt 35. The connector 30 includes an upwardly facing recess 32 to receive a head of the bolt 35, and the recess is so formed as to closely receive the bolt head to prevent the bolt from rotating relative thereto.

When locating the beam, the required number of mounting brackets 20 are provided and an equivalent number of connectors 30 are located in the beam and each is associated with a mounting bracket. Before locating a connector 30 into the channel 13 in the beam, the bolt 35 is passed through the aperture 31 in the connector. These bolts are passed through corresponding apertures in the mounting brackets 20 as can be seen from FIG. 5. It is only necessary to then place a nut 36 on the respective bolt, tighten the nut and the connector pulls downwardly onto the ribs 11, 12, thereby securely fixing the beam 10 relative to the bracket 20.

However should it ever be necessary to remove the beam this can readily be done simply by removing the nuts holding the connectors down and this permits the beam to be removed or, alternatively, the nuts can be loosened and the beam can be moved longitudinally.

It will be seen that as the connectors are located in the channel of the lower track portion 18 of the beam 10 the upper track portion 19 of the extrusion is remote from the connectors so there is no obstruction caused by them to the seats.

The seats 50 of the system may have a complete body shell or, preferably, may have a back portion 51 and a seat portion 52, with the seat portion pivotally connected to the back portion so that when the seat is not being used it can be biassed to rotate upwardly adjacent the back portion to provide minimal obstruction to persons moving along the aisle of the stadium. The positions of the seat can be seen from FIGS. 6 and 7.

This of course is conventional in the art.

In the seat of the invention the back portion 51 may be basically structural and be adapted to carry the weight of the seat. This can be provided by providing a reinforcing beam passing basically around the periphery of the back and by using an engineering grade plastic of the required thickness to give the strength needed.

Both seat 52 and backrest 51 are provided with an innovative system of structural support. This takes the form in both cases of a large section perimeter beam 120, molded integrally with the more generally membranous form of the seating and back surface.

Conventional injection molding processes cannot efficiently create large section details on thin parts due to problems with excessive deformation due to differential shrinkage related to the varying cross section. Heavy sections also require longer cooling times, extending the machine cycle rate beyond cost effective limits.

In our design, nitrogen is introduced into the large section beam during the molding process, the gas pressure forcing the interior material to be displaced into an overflow located at the end of the beam. This creates a hollow beam section with a wall thickness similar to the remainder of the part, eliminating differential shrinkage and maintaining a cost effective machine cycle time.

The seat and backrest of the invention are unique in the application of gas to remove large amounts of material from secondary features of the part. There is an enormous degree of difficulty in achieving this as the features are distributed around the part and large amounts of plastic material must be made to flow in various directions from one area to another.

Figure 8:
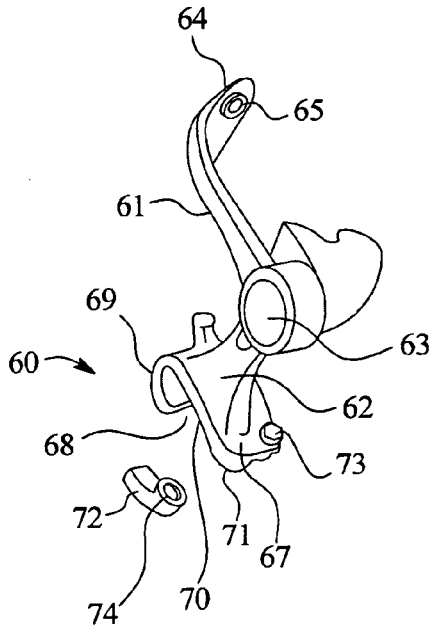
FIG. 8 shows a seat support arrangement.

Associated with the back, there may be a pair of seat supports 60, one on each side thereof. As illustrated in FIG. 8, each seat support 60 may include a clamp portion 68 configured to be mounted to the beam and a seat rotation mechanism 63. Additionally, in the illustrated embodiment, the seat support 60 includes a first support member 62 extending from the clamp portion 68 to the seat rotation mechanism 63, and a second support member 61 extending away from the seat rotation mechanism 63.

The support can be injection molded and could be a glass reinforced plastics material which can have the required strength characteristics.

As illustrated, a free end 64 of the support member 61 is upwardly directed and can be adapted to contact a complimentary shaped part of the seat back 51 within which it can be received and can be held in position by a screw or the like passing through the back into a threaded insert 65 in the free end of the member 61.

By placing this member into the complimentary recess of the seat back, the load is passed through the material of the back rather than the screw which is effectively simply to hold the components together.

A free end 67 of the member 62 is formed as the clamp member 68 which is complimentary to the upwardly directed portion 19 of the beam.

We previously stated that the extrusion comprising the beam has two effectively separate portions 18, 19. The upper portion (as illustrated), referred to herein as the second track portion 19, includes a nose or front overhang 15 which has an undercut surface that is directed inwardly, a curved upper surface 16 forming having at its free end a rear overhang 17 or return that forms another inwardly directed undercut surface.

In the illustrated embodiment, the corresponding clamp portion 68 of the seat support 60 is shaped to have a return portion 69 which is adapted to pass over the rear overhang 17 to grip the beam. The clamp portion 60 further includes an intermediate portion 70 which is curved to correspond with the curved portion 16 of the extrusion and a further forwardly directed portion 71, as shown in FIG. 8.

Provided on the forwardly directed portion 71 of the support member there can be a toggle fastener 72 which is selectively movable from a position where it is free of the beam 10 to a position such that the fastener 72 fits under the nose or front overhang 1 5 of the beam. The fastener 72 can be tightened by way of a bolt 73 through the clamp portion 68 into a threaded aperture 74 in the fastener 72 to prevent any movement of the seat.

This arrangement is most satisfactory as it means there are no free components which have to be handled separately from the rest of the seat. The seat can simply be brought into position, the return portions 69 on each side passed over the rear overhang 17 of the extrusion, the seat moved downwardly about the track portion 19 until the intermediate portion 70 of the clamp portion abuts the curved portion 16 of the beam 10, the toggle fastener 72 is rotated to lock the seat into position, and the bolt 73 tightened.

This arrangement gives the seat of the invention one of its major advantages.

Firstly, at any time, the seat can be removed from the beam simply by releasing the two toggle fasteners 72 and lifting the seat away from the beam 10. Further, if it is required to vary the spacing of seats, it is relatively simple to loosen the toggle fasteners and simply slide the seats along the beam so that they are either spaced a greater or lesser distance from each other.

There are specific applications, as will be described hereinafter where it is essential that the spacing of the seats be greater than in the basic configuration and it means that if it is required to change the configuration of the seats at any time there is no necessity to make any alteration to the beam or to the seats to permit the adjustment. Specifically, the seats can be moved past the mounting brackets without having to be disconnected from the beam.

This provides a substantial advantage to the stadium operator as these modifications can be done by unskilled or semi-skilled persons without the necessity of the use of any tools other than a spanner to release the tension on the toggle fastener 74.

The seat component itself, where this is pivoted, is connected to the seat rotation mechanism 63 at the junction of the two support members 61 and 62 and may be provided with a two stage action such that the seat lifts automatically when vacated, to an initial position 56 in FIG. 7, somewhat less than vertical and upon application of rearwardly directed pressure, is able to move to a full vertical position or beyond, 57 in FIG. 7.

The purpose of this arrangement is to provide an initial position, which provides for ease of returning the seat to it's downward position, (this is particularly important when the user has stood up quickly and maybe unaware that the seat has automatically risen) and a secondary position that maximizes room in front of the seat so that should the occupant be required to stand to make room for a person passing in front, the seat may be moved to it's most rearward position with out a deliberate effort by the occupant.

In the invention the automatic travel to the initial position, shown as 56 in FIG. 7, may be effected by means of a counterweight positioned at the rear 55 of the seat, while the motion to the secondary position, shown as 57 in FIG. 7, may take place against the force of an helical spring located in the pivot mechanism 63. The purpose of this spring is to return the seat from the secondary position 57 to the initial position 56 once pressure is removed, enhancing the safety and convenience.

It will be seen from the foregoing that the whole of the seat assembly, with the exception of the mounting brackets (which may be steel), the inserted threaded portion at the free end of the upwardly directed arm which is connected to the back, the spring for the return of the seat and a further inserted thread which can be used to hold the seat in position and the toggle are made of plastics material.

The plastics material used may be varied, we have made certain statements about the structural parts in the back and seat members themselves can be made out of engineering grade plastics material by injection molding.

It is preferred that the material is either black or of a dark color to minimize degradation after long contact with ultra-violet light and the material may include additives which increase resistance to ultra-violet light.

There can be associated with the ends of the beam, end caps 80 which ensure no sharp edges of the extrusion are directed outwardly and if required these end caps may incorporate material, such as row numbers. Also, if required these could be illuminated by cabling passing through the aperture 14 in the body of the beam.

It is also possible to provide further cabling associated with the beam whereby audio/visual or other signals are also transmitted, this will be described hereinafter.

Figure 9:
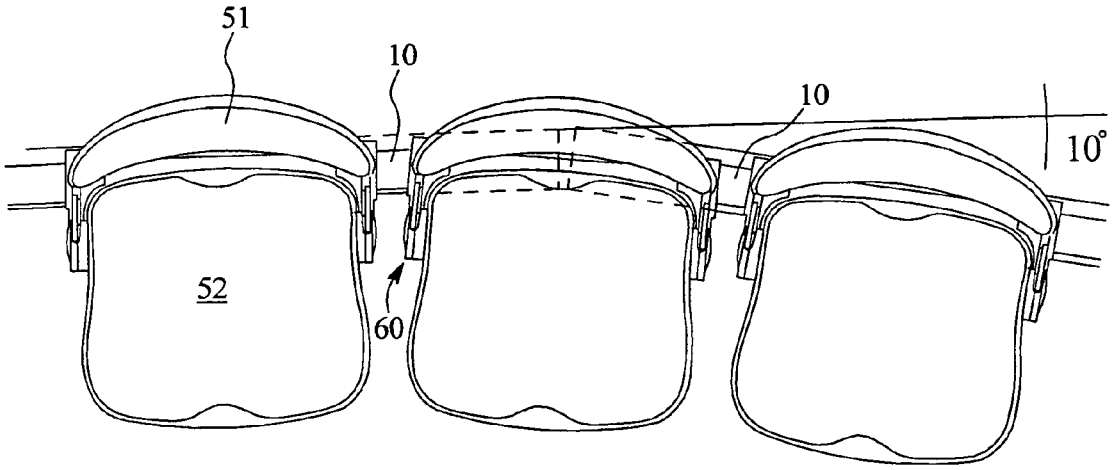
FIG. 9 shows the attachment of a seat to beams at an angle to each other.

Another aspect of the invention, as illustrated in FIG. 9, is that seats can be located so that one seat support 60 is connected to one beam 10 and the other to a second beam with the beams at an angle to each other. The clamp portion 68 on the lower member 62 of the seat support 60 can have a degree of movement relative to the beam or can be provided with means whereby a portion can be removed to give such a degree of movement so that one member is connected to one beam and another member is connected to an adjacent beam with there being an angle of, say, up to 10 degrees between the two beams.

This is a particularly useful aspect where the location of the stadium seats are required to be curved, say to follow a boundary of the stadium, as, if a number of relatively short beams are used there is no restriction on the location of the seats as, should it be required, they can span two adjacent beams. This means there does not have to be a gap in the seating where the different beams are located.

The seat of the invention may be provided with a large number of variations.

For example, the seat portion may be provided with upwardly directed mushroom type extensions which are adapted to receive keyed slots in a cushion portion so this can be located on the seat simply by passing a larger diameter portion of the slot over the mushroom head and then moving the cushion towards the back of the seat.

This cushion can then be located by one screw or the like. Thus, should there be any damage to the cushion at any time it is simple to replace the cushion portion and it is unnecessary to move the seat.

Figure 1:
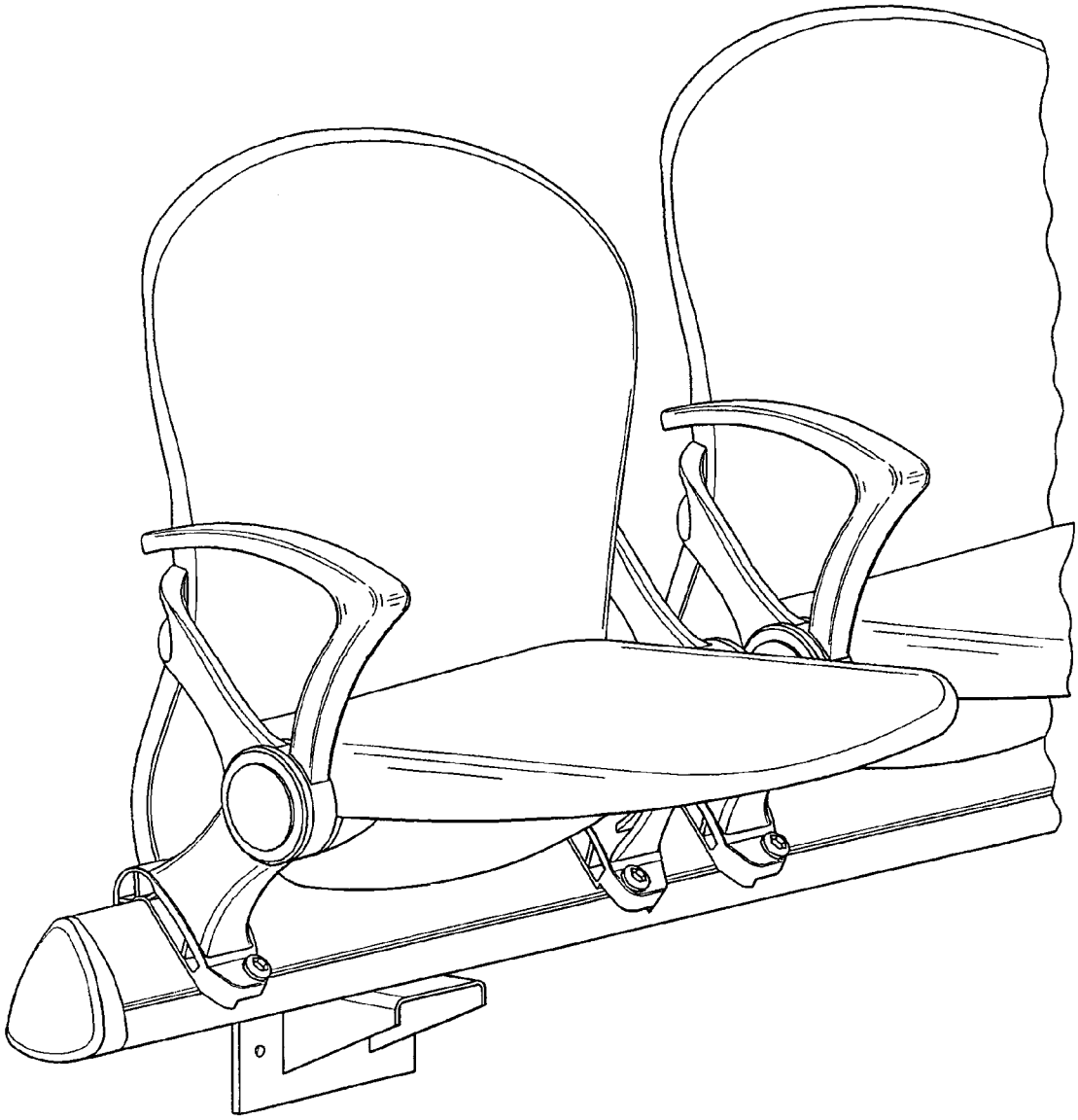
FIG. 1 is a perspective view of a seat of the invention and the beam to which it is attached.
Figure 2:
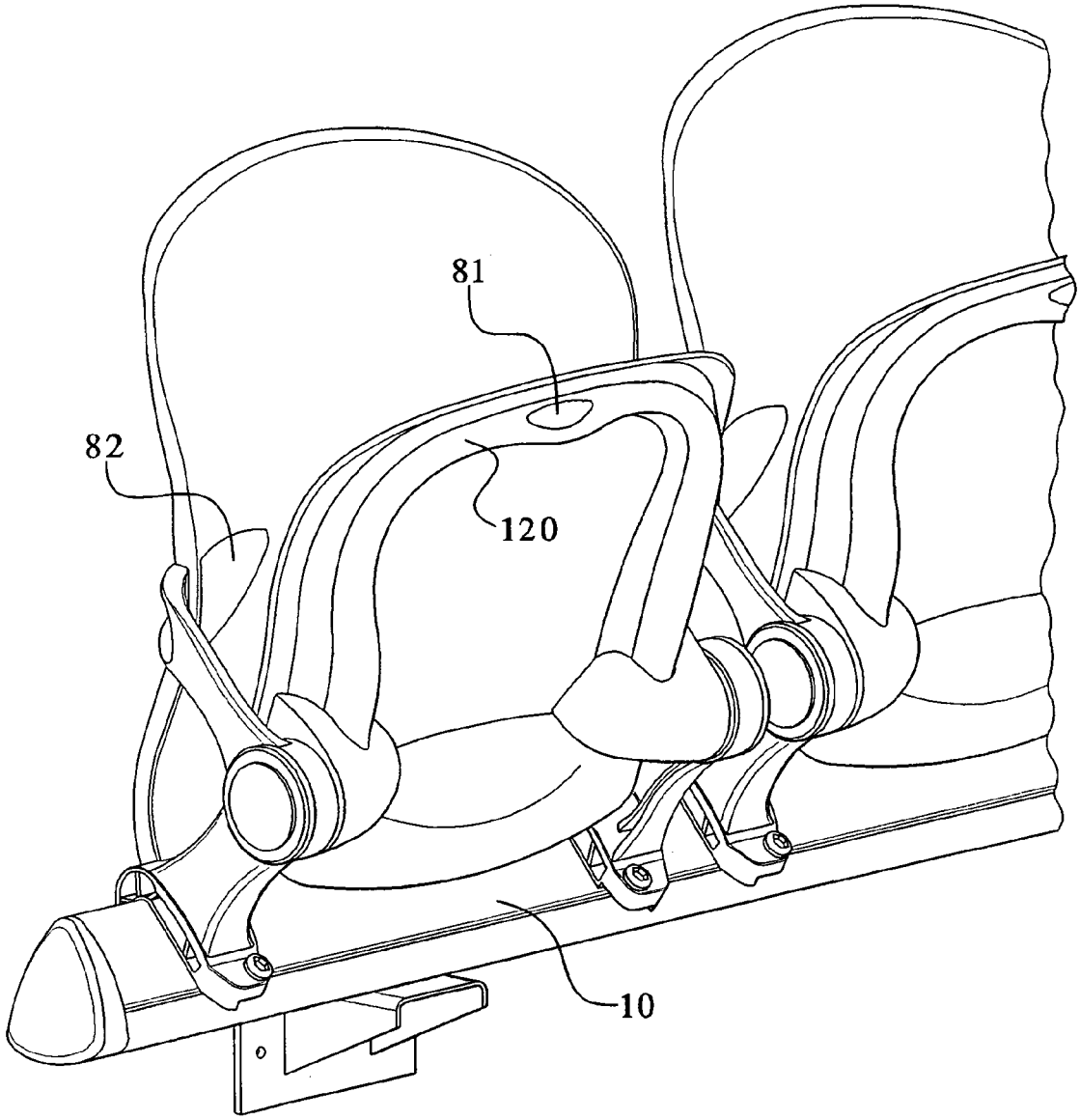
FIG. 2 is a view similar to that of FIG. 1 which the seat portion raised.

Also, if required, on the front of the seat portions there can be a cut out recess into which can be passed a corresponding member which can incorporate a seat number 81 (see FIG. 2) and, if required, can be color coded.

Similarly we may prefer to provide a recess in the seat back which is on the forwardly directed part of the back but is basically in alignment with the recess which receives the free end 64 of the member 61 of the seat support 60 which may incorporate the aperture through which the screw holding the support in position is passed. This recess can be provided with a cover member 82 which is of the same color as the remainder of the back or, if required, could be of an identifying color which could be the same as that used on the seat number on the seat portion.

Thus, it is possible to define positions in the stadium by the use of a color to indicate whereabout on the boundary of the stadium the seat is located, the row, which can be provided in the cover at the end of the beam at the aisles and the seat number.

Each seat can be modified in a substantial number of different ways.

Figure 10:
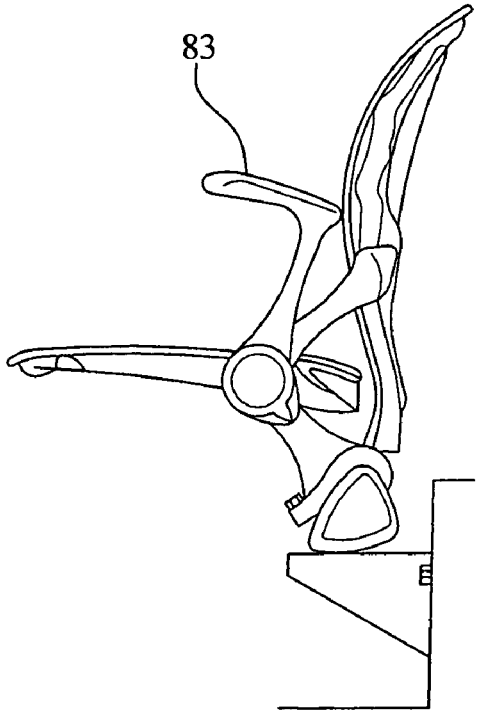
FIG. 10 shows a first form of arm rest used with the invention.
Figure 11:
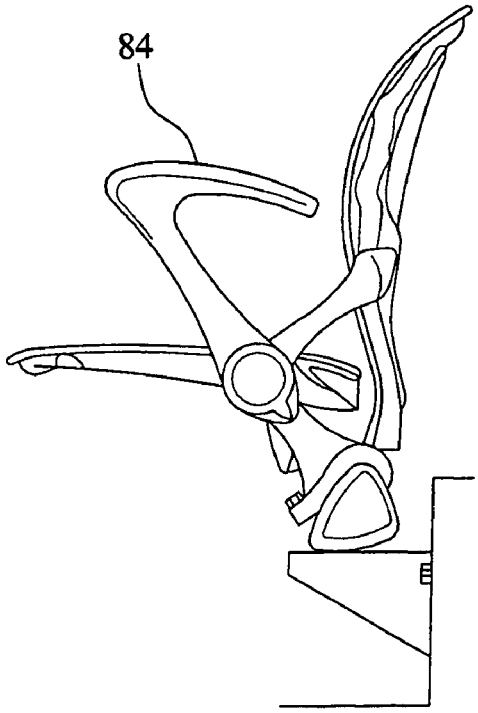
FIG. 11 shows a second form of arm rest.

For example, if it is required to have arm rests on the seat these can simply be located in position at the pivot area of seat supporting pivots and can readily be fitted by the stadium operator after the seats have been located. Examples of suitable arm rests 83, 84 are illustrated in FIGS. 10 and 11.

If the seats were originally located very close together it may be necessary to move or to space them somewhat to provide room for the arms but as described earlier this is a simple and non-skilled operation.

We can provide high backs, not illustrated, for the seats. These can serve two purposes. Firstly, they can give an impression of additional value and can add to comfort and secondly, they can provide additional height to the seat back as far as a person walking along the row behind is concerned. This can be particularly valuable in stadiums which rise steeply as persons could suffer vertigo or discomfort whilst walking along a row of seats where there appears to be no form of support on the low side.

These additional seat backs can take any required form but we do prefer to leave a space between the original back and the additional back to permit circulation of air behind the user.

Figure 12:
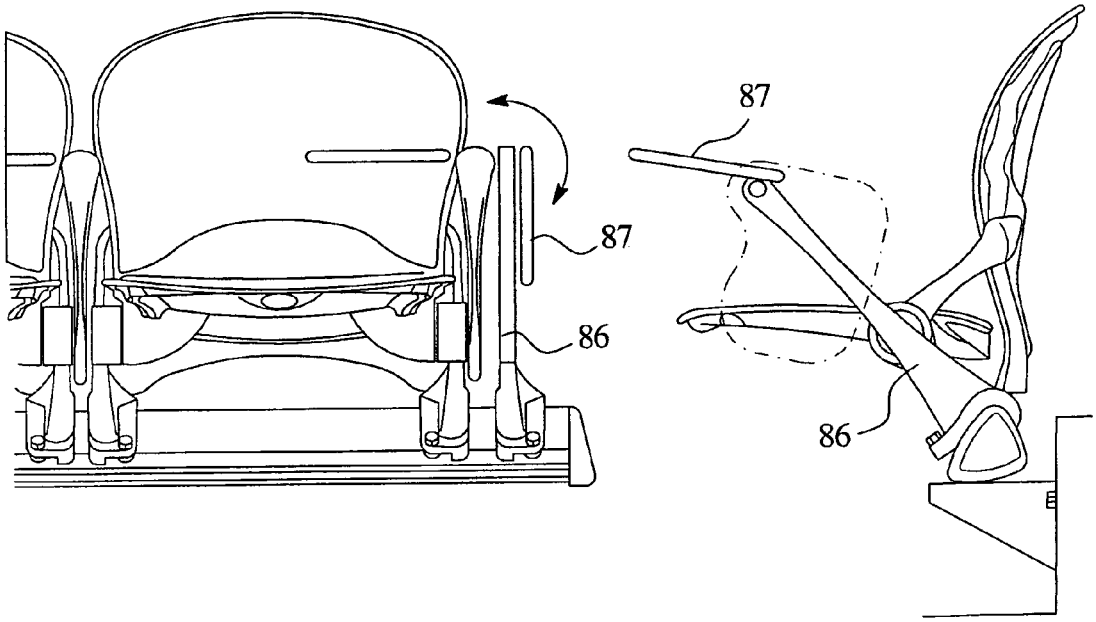
FIG. 12 shows a form of writing tablet suitable for use with the invention.

We can, if required, provide writing tablets associated with each seat, although these would normally be used in auditoria rather than in stadiums and in each case the tablet can fold away to a position beside the seat when not being used. It can be raised upwardly and positioned in front of the user when it is being used. One particular arrangement is shown in FIG. 12 where there is a writing tablet assembly 85 which has an arm 86, which may be connected to the beam 10 and a writing surface 87 which can be rotatable abut the arm to adopt a use position, shown in full line in the Figure and a stowed position, shown in dotted line.

The writing tablet can be provided with connections for power and data so the occupier could connect a laptop computer or other device to power for extended operations and/or to a data line for direct transmission of data.

Again, these use additional space and if the seats were originally closely spaced they can simply be moved outwardly to permit the location of the writing tablets after the seats are already in position.

Also, if required, we can space the seats and locate beam mounted tables between the seats.

This can be useful in suites in hospitality areas where space is not necessary of a premium but where it is desired to make the users feel comfortable.

Each seat may be provided with its own video screen 90 so that replays of just completed portions of the game or other material such as a concurrent television broadcast of the event being watched, or even another event, can readily be viewed by the user which screens may be normally located in an arm 91 associated with the seat and which may be brought into position in front of the occupier of the seat. Associated with these screens there may be an audio arrangement, which can have a speaker or speakers on the screen assembly or elsewhere on, or associated with, the seat.

In one particular form of the invention, the screen 90 is movable from a position at which it is located in a casing 91 or the like beside the seat and which may be connected to the beam 10. The casing may act as an arm rest and has an upper portion 100 which can be hingedly connected thereto, the upper portion acting as the arm rest portion when the screen is within the casing. The screen can be moved outwardly from the casing when it is to be used.

Figure 13:
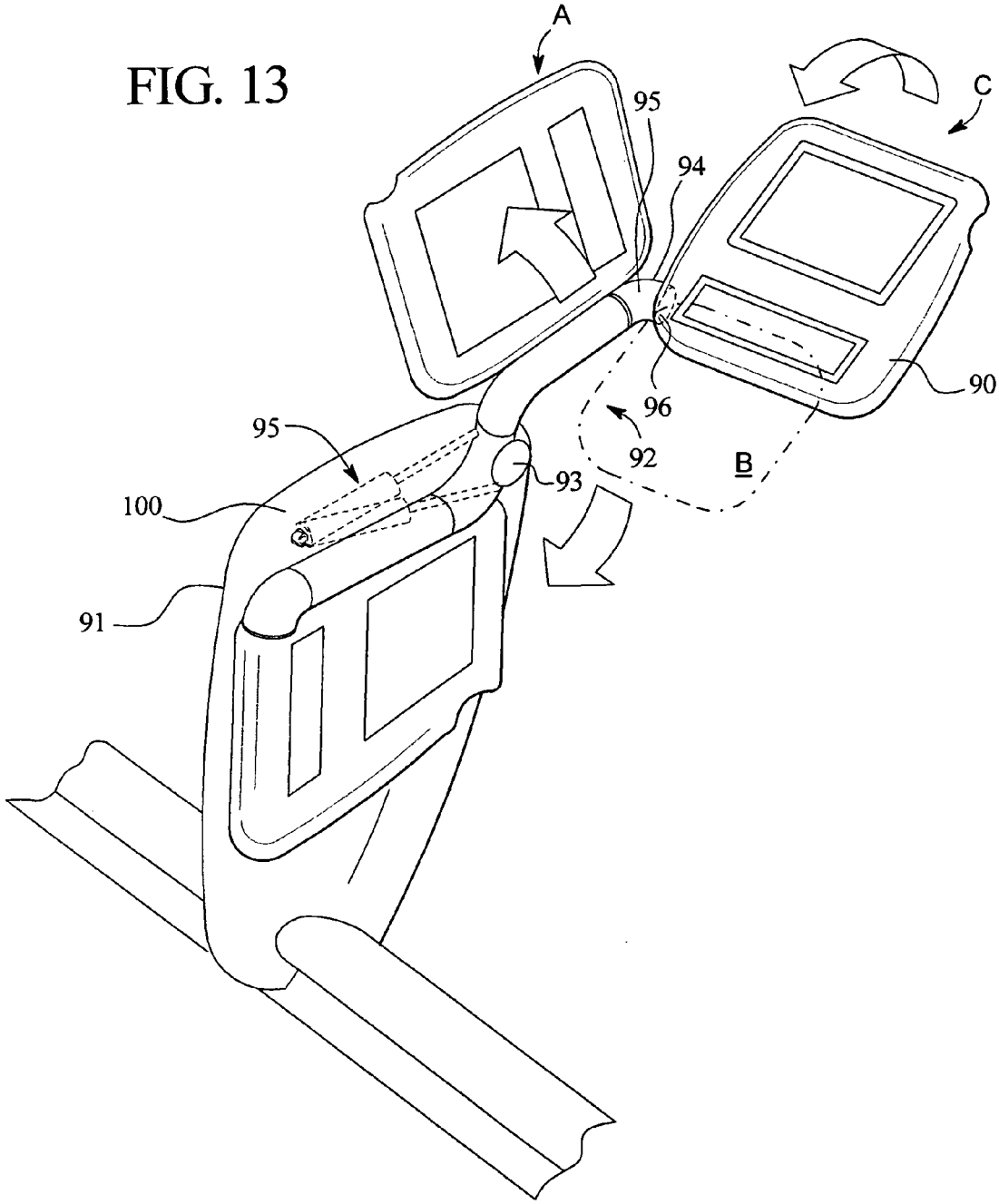
FIG. 13 demonstrated a possible connection of a video and/or audio/video arrangement.

The arrangement comprises an arm 92 which is pivotally connected at one end 93 so that it can be rotated from a first position where it is within the casing or the like to a second position where it extends outwardly therefrom as shown in FIG. 13. The arm 92 has, at its outer end, an elbow member 94 one end 95 of which is rotatable about the axis of the arm 92 and the other end 96 of which is rotatably connected to the screen assembly 90.

The movement of the arm 92 about its pivot 93 is controlled to a degree by a gas strut 95.

The gas strut is connected between the casing and the arm and the location of the strut is such that, on movement of the arm from the position at which it is received within the casing 91 to the position at which is extends fully outwardly therefrom, as illustrated in FIG. 13, the strut is first compressed until it is part way our of the casing and then extends. That is, at the two extremes of movement it acts to hold the arm in the required position and between these it moves over centre.

That is, there is initially a positive force to maintain the screen in position within the casing and when the screen 90 is being deployed the arm 92 initially moves outwardly against the pressure of the strut 95 until it reaches part way along its movement when the strut goes over centre and then assists in causing the arm to move outwardly to its final position and to retain it in this position. To return the arm to the casing it is necessary to work against the strut during the first part of the movement and then the strut acts positively to finalize the movement.

The end 96 of the elbow, as previously mentioned is rotatable about the axis of the arm and can move between two positions. In one of these, the screen assembly can be able to be located in the recess in the casing, and this can be controlled by a form of positive engagement to ensure that the screen is in the required position to be placed in the recess. This is the position marked A on FIG. 13. Rotation of the screen assembly about the arm can bring the screen into the position illustrated at B and this by simply e controlled by a limiting abutment or the like in the assembly.

The screen assembly 90 is rotatably connected to the other end 94 of the elbow and this rotation may have a stop, preferably a positive stop or detent at the position illustrated at B and the rotational movement my be basically frictional to enable the screen to adopt the position shown at C, the angle of which can readily be adjusted so that the screen angle is correct for the particular user.

In order to stow the screen, it is first moved from position C to position B, by rotation of the screen about the end 96 of the elbow, the end 95 of the elbow is then rotated about the arm 92 to the position illustrated as A and then the assembly is rotated about pivot 93 causing the screen to enter the recess in casing.

The elbow member 94 has an aperture passing directly therethrough and the arm 92 is hollow so that the necessary cabling for the screen is passed through the arm, through the elbow to the screen itself. It will be seen that such an arrangement is both aesthetically pleasing but also provides protection for the cabling against accidental or deliberate damage.

The form of casing into which the screen passes and its method of connection to either the seat or itself or the beam on which the seat is mounted can be varied depending upon the particular requirements.

The arrangement could be such that there is a micro switch associated with one of the components so that when the screen is moved to the exposed position, it is automatically caused to operate. Alternatively, there could be a user operated switch on the screen. Also, if required the screen may have brightness and contrast controls which are operable by the user, or these can be located in the recess for adjustment by a technician. A volume control for the speakers) can also be provided at some appropriate position.

If required, the seats themselves could be arranged to be folded and moved under a cover or otherwise located when not required.

Generally, it is required that this be more or less weather proof, although the seats having the screens would normally be under cover, and also be provided with surfaces which cannot readily be manipulated by users.

It is also possible to provide seats which are able to be pivoted away from the beam to open a space for, for example, a person in a wheelchair to be able to have access to an area in their chair.

In the specification we have described one particular form of seat and many possible variations in this and it is to be understood that these are not exhaustive but other variations can be provided without departing from the spirit and scope of the invention.

What is claimed is:

1. A seating system comprising:

an elongate beam including:

a first track portion configured to be secured to a series of fixed connectors at any position along a length of the beam; and a second track portion extending integrally parallel to the first portion;

a plurality of seats, each of the seats including at least one support with a clamp portion configured to mount to the second track portion of the beam at any position along the length of the beam, the clamp portion being removable from the second track portion to facilitate repositioning along the beam after installation;

wherein the clamp portion remains free from the first track portion so as to avoid interfering with any of the fixed connectors;

wherein the fixed connectors remain free from the second track portion to avoid interfering with any of the supports; and wherein the first track portion forms a channel, the channel being shaped to cooperatively receive the series of connectors; the first track portion including a slot-shaped opening to the channel and a pair of inwardly turned ribs disposed along opposite sides of the opening, the ribs contacting against the connectors within the channel; the connector including an aperture therethrough and a bolt having a head that contacts against an upper side of the connector and a shaft that extends through the aperture and through the opening, the bolt being securable to the bracket to hold the connector against the ribs from within the channel.

2. The seating system of claim 1, wherein the first and second track portions are unitarily formed.

3. The seating system of claim 1, wherein opposite ends of the beam include an opening to the channel sized to slidably receive the connectors into the channel.

4. The seating system of claim 1, wherein the channel opening faces generally downwardly, and wherein the first track portion is formed by a lower portion of the beam, and wherein the second track portion is formed by an upper portion of the beam.

5. The seating system of claim 1, wherein the second track portion includes a pair of overhangs that extend outwardly along opposite elongate sides of the beam.

6. The seating system of claim 5, wherein the clamp portion of the support includes a return portion shaped to cooperatively fit over one of the overhangs.

7. The seating system of claim 6, further including a fastener that is mounted to the clamp portion such that the fastener can selectively secure under the overhang opposite the overhang engaged by the return portion.

8. The seating system of claim 7, wherein the overhang to be gripped by the fastener has an angular cross-sectional profile.

9. The seating system of claim 6, wherein the overhang to be gripped by the cooperatively shaped return portion has a rounded cross-sectional profile.

10. The seating system of claim 1, wherein the support is removably mountable to the second track portion.

11. The seating system of claim 1, wherein each of the seats includes a seat portion and two of said supports, wherein each of the supports includes a seat pivot mechanism, the seat portion being mounted to the respective seat pivot mechanisms.

12. The seating system of claim 11, wherein each of the seats includes a back portion mounted to the respective supports.

13. A seating system comprising:

a plurality of brackets mounted to a fixed surface;

a plurality of connectors, each of the connectors being mountable to a respective one of the brackets;

an elongate beam adapted to be mounted to the connectors in a generally horizontal orientation, the beam including a lower portion defining a channel, the channel being shaped to slidably receive the connectors from an end of the beam, the beam also including an elongate upper portion having a rear overhang with a rear undercut surface that projects in a first direction and a front overhang having an undercut surface that extends in a generally opposite direction from the rear overhang; and at least one seat support, each support including a clamp portion adapted to be removably mounted to the upper portion free of the lower portion so that the seat base can be mounted at any position along a length of the beam free from interference with the connectors and brackets, the clamp portion including a return portion that is cooperatively shaped to fit against the upper portion and over the rear overhang in contact with the undercut surface, the support further including movable fastener mounted to the return such that the fastener grips over the front overhang in contact with the front undercut surface.

14. The seating system according to claim 13, the lower portion including a pair of parallel, opposed ribs that are inwardly directed relative to the channel, the ribs defining an opening to the channel, the ribs contacting against the connectors within the channel.

15. The seating system of claim 13, wherein the connector includes an aperture therethrough and a bolt having a head that contacts against an upper side of the connector and a shaft that extends through the aperture and through the opening, the bolt being securable to the bracket to hold the connector against the ribs from within the channel.

16. The seating system of claim 15, wherein the connector has a recess to receive the head of the bolt in a recessed matter, the connector fitting closely within a cross-sectional profile of the channel.

17. The seating system of claim 13, wherein each of the seats further includes a back portion mounted to the respective supports.

18. The seating system of claim 13, wherein at least one of the seats includes an arm rest, the arm rest being mounted to the support.

19. The seating system of claim 13, wherein each of the seats includes a seat portion and two of said supports, wherein each of the supports includes a seat pivot mechanism, the seat portion being mounted to the respective seat pivot mechanisms.

20. A seating system comprising:

an elongate beam including:

a first track portion configured to be secured to a series of fixed connectors at any position along a length of the beam; and a second track portion extending integrally parallel to the first portion;

a plurality of seats, each of the seats including at least one support with a clamp portion configured to mount to the second track portion of the beam at any position along the length of the beam, the clamp portion being removable from the second track portion to facilitate repositioning along the beam after installation;

wherein the clamp portion remains free from the first track portion so as to avoid interfering with any of the fixed connectors;

wherein the fixed connectors remain free from the second track portion to avoid interfering with any of the supports; and wherein the second track portion includes a pair of overhangs that extend outwardly along opposite elongate sides of the beam and the clamp portion of the support includes a return portion shaped to cooperatively fit over one of the overhangs.

21. The seating system of claim 20, wherein the first and second track portions are unitarily formed.

22. The seating system of claim 20, wherein the first track portion forms a channel, the channel shaped to cooperatively receive the series of connectors.

23. The seating system of claim 22, wherein the first track portion includes a slot-shaped opening to the channel and a pair of inwardly turned ribs disposed along opposite sides of the opening, the ribs contacting against the connectors within the channel.

24. The seating system of claim 23, wherein the connector includes an aperture therethrough and a bolt having a head that contacts against an upper side of the connector and a shaft that extends through the aperture and through the opening, the bolt being securable to the bracket to hold the connector against the ribs from within the channel.

25. The seating system of claim 23, wherein opposite ends of the beam include an opening to the channel sized to slidably receive the connectors into the channel.

26. The seating system of claim 23, wherein the channel opening faces generally downwardly, and wherein the first track portion is formed by a lower portion of the beam, and wherein the second track portion is formed by an upper portion of the beam.

27. The seating system of claim 20, further including a fastener that is mounted to the clamp portion such that the fastener can selectively secure under the overhang opposite the overhang engaged by the return portion.

28. The seating system of claim 27, wherein the overhang to be gripped by the fastener has an angular cross-sectional profile.

29. The seating system of claim 27, wherein the overhang to be gripped by the cooperatively shaped return portion has a rounded cross-sectional profile.

30. The seating system of claim 20, wherein the support is removably mountable to the second track portion.

31. The seating system of claim 20, wherein each of the seats includes a seat portion and two of said supports, wherein each of the supports includes a seat pivot mechanism, the seat portion being mounted to the respective seat pivot mechanisms.

32. The seating system of claim 31, wherein each of the seats includes a back portion mounted to the respective supports.

33. A seating system comprising:

an elongate beam including:

a first track portion configured to be secured to a series of fixed connectors at any position along a length of the beam; and a second track portion extending integrally parallel to the first portion, the second track including a rear overhang that extends outwardly along an elongate rear side of the beam; and a plurality of seats, each of the seats including at least one support, each of the supports having: (a) a clamp portion with a return portion shaped to cooperatively fit over a top of the beam and under the rear overhang at any position along the length of the beam; (b) a seat rotation mechanism; and (c) a support member extending from the clamp portion to the seat rotation mechanism at an angle such that the seat rotation mechanism is disposed forwardly of the beam.

34. The seating system of claim 33, wherein each of supports is configured such that a center of gravity of the respective seat is disposed forwardly of the beam, such that contact of the return portion against the rear overhang holds the seat in a desired position.

35. The seating system of claim 33, wherein the beam further includes a front overhang that extends generally along a front side of the beam, and wherein the clamp portion includes a toggle that is movable under the front overhang to lock the support at a desired position along a length of the beam.

36. The seating system of claim 33, wherein the fixed connectors remain free from the second track portion to avoid interfering with any of the supports.

* * * * *